US008596399B1

(12) United States Patent
Gauld

(10) Patent No.: US 8,596,399 B1
(45) Date of Patent: Dec. 3, 2013

(54) POWERED RIDING VEHICLE

(76) Inventor: Gale Gauld, Fife Lake, MI (US)

( * ) Notice: Subject to any disclaimer, the term of this patent is extended or adjusted under 35 U.S.C. 154(b) by 1694 days.

(21) Appl. No.: 11/710,199

(22) Filed: Feb. 22, 2007

(51) Int. Cl.
*A63C 5/08* (2006.01)

(52) U.S. Cl.
USPC ..... 180/181; 280/12.13; 180/190

(58) Field of Classification Search
USPC ..... 180/180, 181, 184, 185, 190; 280/12.13, 12.14
See application file for complete search history.

(56) References Cited

U.S. PATENT DOCUMENTS

| | | | | | |
|---|---|---|---|---|---|
| 3,707,199 | A * | 12/1972 | Gerich et al. | ..... | 180/190 |
| 3,783,958 | A * | 1/1974 | Canavan | ..... | 180/184 |
| 3,853,192 | A * | 12/1974 | Husted | ..... | 180/181 |
| 3,964,560 | A * | 6/1976 | Husted | ..... | 180/181 |
| 4,035,035 | A * | 7/1977 | Husted | ..... | 180/181 |
| RE29,657 | E * | 6/1978 | Husted | ..... | 180/181 |
| 4,307,788 | A * | 12/1981 | Shelton | ..... | 180/181 |
| 4,519,470 | A * | 5/1985 | Allisio | ..... | 180/180 |
| 4,984,648 | A * | 1/1991 | Strzok | ..... | 180/181 |
| 5,305,846 | A * | 4/1994 | Martin | ..... | 180/181 |
| 5,662,186 | A * | 9/1997 | Welch | ..... | 180/181 |
| 5,738,361 | A * | 4/1998 | Landucci | ..... | 280/12.14 |
| 6,279,923 | B1 * | 8/2001 | Cardillo et al. | ..... | 280/12.14 |
| 6,302,232 | B1 * | 10/2001 | Forbes | ..... | 180/193 |
| 6,435,290 | B1 * | 8/2002 | Justus et al. | ..... | 180/9.1 |
| 6,511,079 | B1 * | 1/2003 | Charles, Sr. | ..... | 280/12.14 |
| D476,599 | S * | 7/2003 | Whittington | ..... | D12/7 |
| 6,698,540 | B1 * | 3/2004 | Decker, Jr. | ..... | 180/181 |
| 7,434,644 | B2 * | 10/2008 | Wier | ..... | 180/180 |
| 7,475,751 | B2 * | 1/2009 | Pard et al. | ..... | 180/190 |
| 2004/0154849 | A1 * | 8/2004 | Fodor | ..... | 180/181 |
| 2004/0238251 | A1 * | 12/2004 | Oron et al. | ..... | 180/180 |
| 2008/0169146 | A1 * | 7/2008 | Brazier | ..... | 180/181 |
| 2008/0257627 | A1 * | 10/2008 | Hues | ..... | 180/180 |

* cited by examiner

*Primary Examiner* — Jeffrey J Restifo

(57) ABSTRACT

A recreational vehicle that is a powered riding vehicle that is maneuvered by shifting the weight of the rider-occupant. The vehicle has a floating and suspension configured drive means and an independent front mounted ski that allows for easy maneuverability.

11 Claims, 5 Drawing Sheets

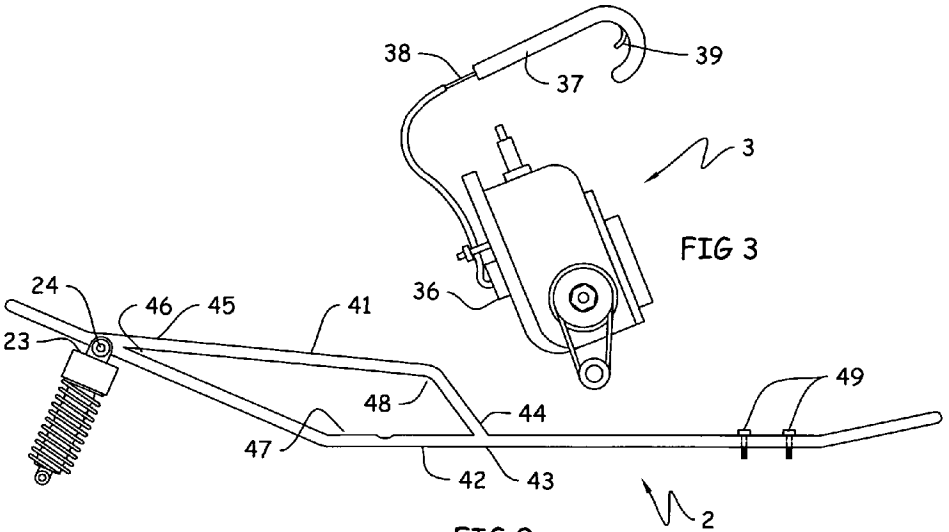
39
37
38
3
36
FIG 3
49
2
44
43
42
48
41
47
45
46
24
23
FIG 2
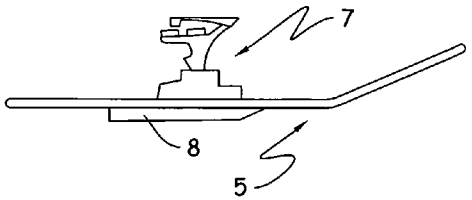
7
8
5
FIG 5
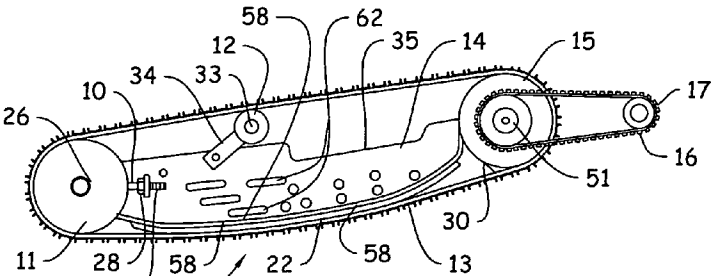
17
16
15
51
14
30
13
35
62
58
22
58
12
33
34
10
26
28
27
11
4
FIG 4

POWERED RIDING VEHICLE

The invention disclosed and claimed herein deals with a powered riding vehicle that is used for recreational sports.

BACKGROUND OF THE INVENTION

As disclosed in U.S. Pat. No. 6,698,540, that issued on Mar. 2, 2004 to Decker, "The capabilities and/or complexity of the control features are problems on many recreational snow devices. For example, some devices are linked to a motorized propulsion unit such that there is little or no flexibility or pivoting ability of the propulsion unit relative to the user platform. Yet other designs offer multiple degrees of freedom between the user platform and the propulsion device, but provide this in a relatively large, complex mechanism. Yet other designs allow for pivotal movement of the user platform relative to the propulsion device, but do not provide any mechanism for restoring alignment of the two devices. What are needed are apparatus [sic] and methods which overcome these failings."

The device of the present invention falls into the category of guidance of the device through the shifting of body weight, much the same as non-propelled snowboards and skateboards. Thus, the device of the instant invention does not have the problems associated with the prior art devices according to Decker.

In addition, there is a great number of patented devices that are motorized riding boards and these are supported by, and travel on wheels. It is considered by the inventor herein that none of those devices constitute prior art devices owing to the employment of wheels and in some cases, steering devices.

In U.S. Pat. No. 5,305,846, that issued Apr. 26, 1994 to Martin, there is disclosed a motorized trackboard that has a rear mounted engine that transmits rotary motion centrally to a rear drive track at each side of a trackboard platform. It is an all-terrain vehicle that can be made small and light enough for a child to use or large enough for a seat for heavy use. The riding platform is supported directly on top of the drive means such that there is no suspension system that severely limits the capability of maneuvering the vehicle.

A similar device is disclosed in U.S. Pat. No. 6,435,290, that issued on Aug. 20, 2002 to Justus, et al. The device has been characterized as a land vehicle and has a flexible central from member which extends from a large front roller to a smaller rear roller and is encircled by a flexible looped belt having projecting treads, in other words, an endless drive belt. An engine is mounted above the belt that drives the front roller and two bogie wheels engage the belt within valleys formed in the treads. The vehicle is controlled by twisting and tipping the vehicle in a manner similar to the control of a conventional unpowered snowboard. These devices also suffer from the fact that there is no suspension system, among other features, that prevents it from being easily maneuvered.

U.S. Pat. No. 6,698,540, that issued on Mar. 2, 2004 to Decker (disclosed Supra), deals with a two-piece motorized snowboard that is designed to enhance the maneuverability of the device by providing a jointed pivot point between the skis and the propulsion mechanism.

On additional disclosure is U.S. Pat. No. 5,662,186, that issued Sep. 2, 1997 to Welch in which there is shown a power-driven snowboard that includes forward and rear regions. A drive unit is removably attached at the rear region of the snowboard and it includes a drive unit mounting assembly, a plurality of rollers rotatably supported in the mounting assembly, a motor propelling the snowboard, and a drive belt supported the rollers and drivingly connected to the motor.

The entire track or belt lays in contact with the ground (snow) and there is no suspension system in the device. These two features, among other, prevents this device from being as maneuverable as the device of the instant invention.

THE INVENTION

The invention disclosed and claimed herein deals with a powered riding vehicle that is used for recreational sports.

The invention is a powered riding vehicle, the vehicle comprising in combination a support frame having a front component with a top, a distal end portion, and an elevated rear component also having a distal portion.

There is a motor for powering the vehicle, the motor being mounted on the top of the front component and having an exterior drive means wherein the exterior drive means is drivably attached to an endless drive track for the vehicle, that is, the drive track is mounted beneath the elevated rear component and mechanically moveably attached to the exterior drive means of the motor wherein the drive track is guided by a glide support having a distal end, and guide wheels having a common axle.

There is a truck mounted beneath the front component and near the distal end portion of the front component thereof, the truck having a distal end and there is mounted on the distal end of the truck a moveable ski, said moveable ski having an underside surface.

There are shock absorbers located and mounted beneath the elevated rear component near the distal portion and there is a means of controlling the acceleration and deceleration of the motor.

BRIEF DESCRIPTION OF THE DRAWINGS

FIG. 2 is a full side view of the support frame of the device of this invention and also showing an attached suspension mechanism.

FIG. 3 is a full side view of the motor of this invention.

FIG. 4 is a full is full side view of the drive belt and auxiliary equipment for the drive belt.

FIG. 5 is a full side view of a truck having a ski mounted thereon.

DETAILED DESCRIPTION OF THE INVENTION

Figure 1:
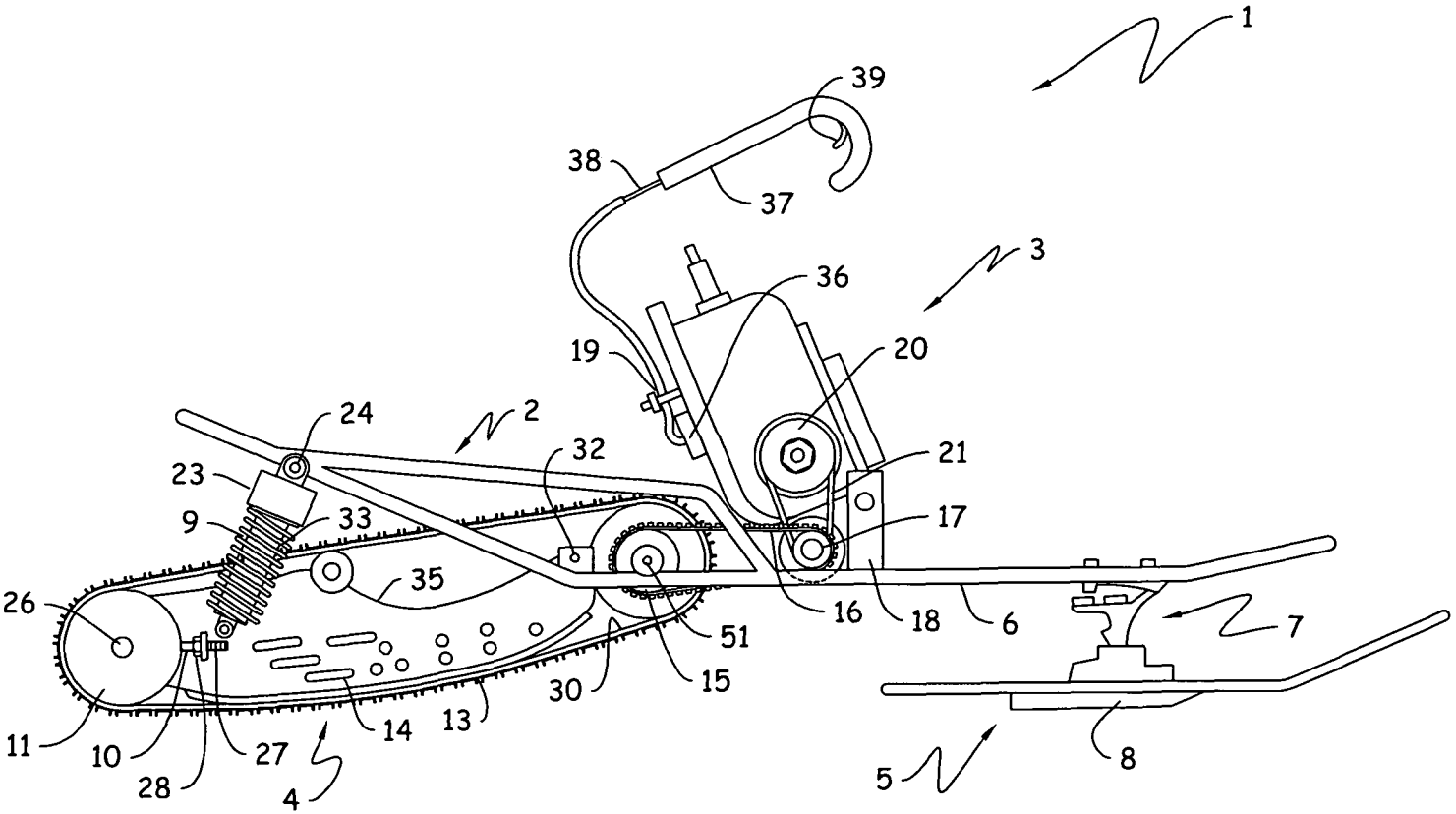
FIG. 1 is full right side view of a device of this invention.

Turning to FIG. 1, there is shown one embodiment of a device 1 of this invention. There is also shown a support frame 2, a motor 3, attached securely to the frame 2, a drive mechanism 4 that is driven by the motor 3, and a single ski 5 attached to the under surface 6 of the frame 2 using a truck 7.

For purposes of this invention, reference is made to U.S. Pat. No. 7,121,566, that issued Oct. 17, 2006 to McClain for an explanation of a "truck". Trucks are common in the skateboard industry and are an assembly that is used to provide control of the skateboard. Skateboards are typically made of three main components, those being a deck, truck assemblies, and wheels. Decks, which are sometime known as boards, usually have a flat center portion that accommodates the feet of the rider. Decks are typically elongated such that they are longer in length from the front to the rear of the deck than in width from either side of the deck. The front and/or back of the deck may in some instances be upturned in relation to the center portion of the deck.

The wheels of the skateboard are attached to the deck via the truck assembly. The truck assembly is provided with an axle onto which a pair of wheels is rotatably mounted. The truck assembly and wheels are mounted onto the bottom of the skateboard towards the front portion. A similar truck assembly with wheels is likewise mounted to the bottom of the skateboard near the rear portion. The two truck assemblies may be either identical, or of different configurations according to commonly known designs.

During operation of the skateboard, the rider may position his or her feet at any location on the board in order to control the skateboard in response to a given situation. For example, the rider may have one foot located at the upturned rear portion of the board while the other foot is at the upturned front portion of the board. In order to turn left to right, the rider may shift his or her weight such that the deck is tilted about a longitudinal axis. This tilting is accommodated by the truck assemblies that allow for the wheels to be pivoted in order to accommodate a left or right turn. It is intended to cite the above-identified '566 patent to give a definition of a truck, and is not intended to limit the instant invention to just that type of truck.

In this Figure, there is also shown a blade 8, on the ski 5, a shock absorber 9 of two shock absorbers used in this invention, a tension adjustment 10 on the guide wheel 11, a bogey wheel 12 (there is a pair of bogey wheels) for the drive belt 13, a slide rail assembly 14, having a main part which is the slide rail 61, a pivot connection of the slide rail assembly 32 to the frame 2, a drive wheel 15 for the drive belt 13, a drive connection 16 between the drive wheel 15 and a drive pulley 17 on the motor 3. The bogey wheels 12 are rotatably mounted on an axle 33 that is mounted on braces 34 on either side of the slide rail assembly 14 (shown for more clarity in FIG. 4). The braces 34 are attached to the top edge 35 of the slide rail assembly 14.

The slide rail assembly 14 is the component that bears the weight of the device 1, and the person riding it, inside the drive belt 13. In the inventive device, there is only one such slide rail assembly 14 as opposed to two such assemblies on snowmobiles. The drive belt 13 slides under the slide rails and contacts the ground surface. The stresses on the slide rail assembly 14 are magnified when the device 1 is operated under adverse conditions, such as, on surfaces where there is no snow or water to cool and lubricate the interface between the slide rail and drive belt 13, or on surfaces that cause debris such as dirt, sand, and gravel that contaminate the interface between the slide rail assembly and the drive belt 13.

Thus, the slide rail 61 is equipped with a wear blade 22 that is fitted on the bottom edge of the slide rail 61. Such replaceable wear blades are known in the art, for example, U.S. Pat. No. 5,571,275 that issued to Cyr on Nov. 5, 1996 and U.S. Pat. No. 3,770,330 that issued to Bombardier. One commercial Hyfax-type slider is manufactured by several different companies. One such company is Garland Industries, P.O. Box 538, Saco, Me. 04072.

Also shown is a motor mount 18 for stabilizing the motor 3 to the frame 2 and this is aided by a second motor mount 19 for stabilizing the top portion of the motor 3 to the frame 2. Finally, there is shown a clutch apparatus 20 on the motor 3 that is drivably attached to the drive pulley 17 by a drive chain 21, and a glide bar 22 that is attached to the slide rail assembly 14 at the bottom. The motor is a conventional motor and is sized according to the power desired in propelling the device. Normally, this size is equivalent to a motor that is used on a standard chain saw and has a horse power in the range of 2.5 to 6.

It should be noted that the shock absorbers 9, at their near ends 23, are attached to the support frame 2 by any standard means, such as bolt and nut 24. It is important that this attachment allow the shock absorbers 9 to move about the attachment means 24 so that the shock absorbers 9 can accommodate the limited rotational movement of the slide rail assembly 14 as it encounters bumps and holes in the snow, ice or the ground. Also, it should be noted that the distal end of the shock absorber 9 is attached to posts (not shown) that are mounted on the side of the slide rail assembly 14, by a similar fastening means 25 such that the slide rail assembly 14 and the shock absorbers 9 can move rotationally with regard to each other. The posts in the slide rail assembly 14 extend from the side of the slide rail assembly 14 the necessary distance to keep the shock absorbers 9 from touching the drive belt 13 or the bogey wheels 12.

With reference to FIGS. 1 and 4, the guide wheels 11 are intended to support the back end of the drive belt 13 and the guide wheels 11 are rotatably mounted on an axle 26 that passes through the slide rail assembly 14 and rotatably attaches to a like guide wheel 11 on the other side of the slide rail assembly 14.

The tension adjustment 10 touches the axle 26 and it is at this point that the tension in the drive belt 13 is adjusted for optimum performance. The tension adjustment 10 is securely attached to the side of the slide rail assembly 14 and the screw 27 turns in and out relative to a nut 28 that is secured to the slide rail assembly 14. By turning this screw out, the tension adjustment 10 touches the axle 26 and causes the guide wheel 11 to press against the inside surface 30 of the drive belt 13 and tighten the drive belt 13 against the various wheels and guides that it rotates around. Conversely, by turning the screw 27 in, the guide wheel 11 moves away from the drive belt 13 and decreases the tension in the drive belt 13 relative to the various wheels and guides that the drive belt 13 rotates on. The various wheels and rotational points on the inventive device can be equipped with bushings or ball bearing assemblies as the need requires. This is common in the art.

Aside from the connection of the slide rail assembly 14 to the shock absorber 9, there is only one other point of attachment of the slide rail to the support frame 2. This is the pivot attachment 32 that allows for a partial rotation of the slide rail assembly 14 relative to the frame 2. The combination discussed just Supra, allows for the drive mechanism 4 to move independently of the support frame 2 to not only provide shock absorbing capabilities, but this combination provides for the drive mechanism 4 to contact the ground for maximum driving power, and it also aids in maneuvering the device 1 as it is being operated.

It should be noted that the slide rail assembly 14 is fitted with a wear blade 29 on the bottom edge of the slide rail assembly 14. This wear blade 29 engages the inside surface 30 of the drive belt 13 and not only guides the drive belt 13 along its intended path, but it also provides for positioning and holding the drive belt 13 to the snow, ice or ground on which it is being operated. In FIG. 4, it should be noted that the slide rail has a thinner top section perforated with holes to lessen the weight of the slide rail, and line 60 is in fact a ridge line for the thicker bottom portion of the slide rail.

The motor is equipped with an ignition box 36 from which has connected to it an accelerator cable housing 37 which encases an accelerator cable 38 that terminates in a trigger mechanism 39 for increasing or decreasing the acceleration of the device 1.

Figure 6:
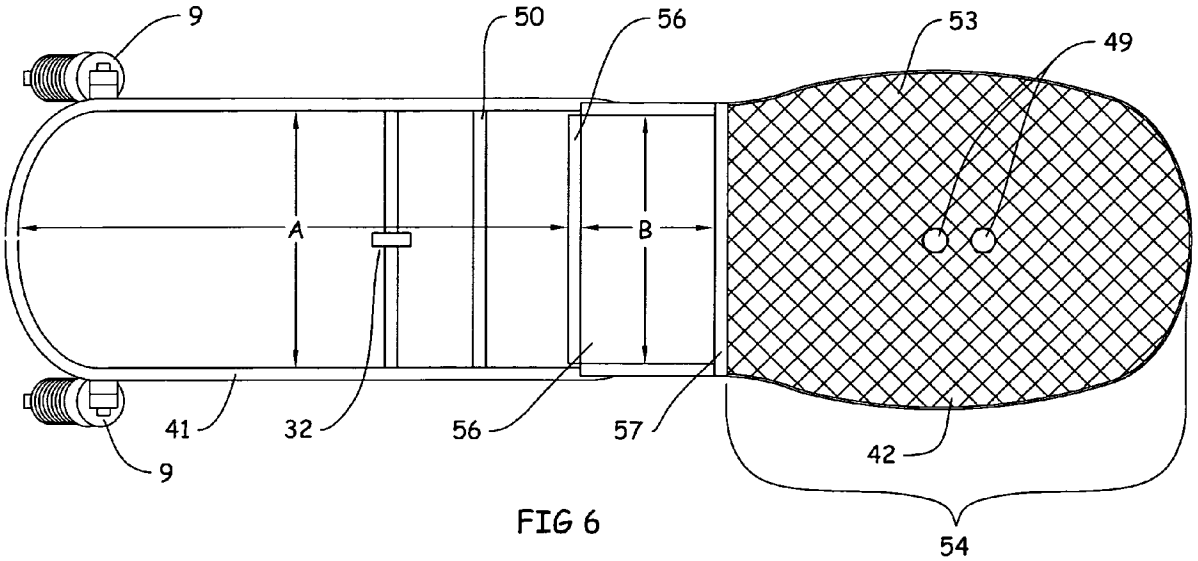
FIG. 6 is a full top view of the support frame of this invention shown the front portion with a metal grid covering.

Turning now to FIGS. 2 and 6, there is shown a support frame 2 having upper side rails 41, lower side rails 42. Upper side rails 41 connect by their near ends 44 to the lower side rails 42 at about the mid-section 43 of the support frame 2 and the distal end 45 of the upper side rails 41 connects to the lower side rails 42 at or near the back end 46 of the support frame 2. It is noted that this provides a bend 47 in the lower side rails 42 and a bend 48 in the upper side rails 41. This configuration accommodates the mounting of the motor 3, shown in FIG. 3. Also shown in FIG. 2 are the mounting bolts 49 for the truck 7.

With further reference to FIG. 2, there is shown a first brace 50 which also serves as the axle housing for the axle 51 that has mounted on it the drive wheel 15 (FIGS. 1 and 4). There is also shown a second brace 52 that is a cross brace for the support frame 2, but also is a point at which the pivot attachment 32 for the slide rail assembly 14.

Area designated "A" in FIG. 6 is normally covered with a metal mesh 53, such as that fund on the front segment 54 of the support frame 2. However, in order to illustrate the cross bracing, the metal mesh 53 was not put into FIG. 6. Area "B" is not covered with metal mesh 53, but is an open space 55 that accommodates the bottom half of the motor 3. Points 56 and 57 are the points of attachment of the motor 3 to the support frame 2. Also shown are the shock absorbers 9.

Turning now to FIGS. 1 and 5, in FIG. 5 there is shown a combination of a truck 7 and a ski 5, wherein the ski 5 has a cutting blade 8 attached to the bottom thereof. As discussed Supra, the truck 7 greatly contributes to the capability of the device 1 to be maneuvered. as it allows the device 1 to be tilted using body weight of the user to steer the device 1. In addition to the truck 7, the steering is aided, especially on ice, by the use of a cutting blade 8. It is contemplated within the scope of this invention to utilize more than one cutting blade 8 on the bottom surface of the ski 5.

Figure 7:
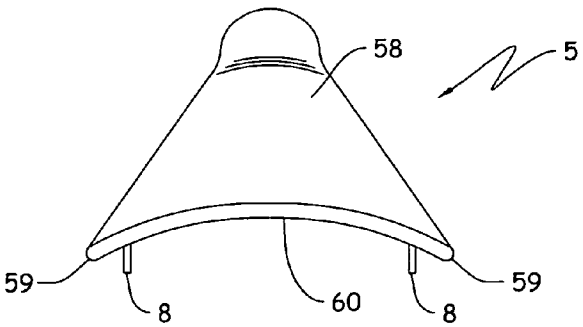
FIG. 7 is view from the back of an additional embodiment of a ski that is used in this invention.
Figure 9:
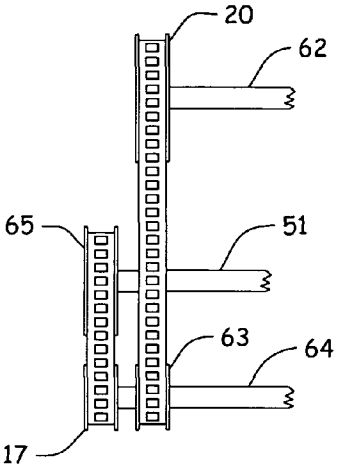
FIG. 9 is an end view of the combination of FIG. 8.

The ski 5 closely resembles the front half of a conventional snowboard. The ski 5 is essentially flat, having to parallel edges and an upturned front tip 58. In another embodiment of this invention as shown in FIG. 7, the ski 5 is not flat, but has a slight parabolic arch 60 between the two parallel edges 59. This configuration of the ski 5 is preferred for use on ice surfaces.

Figure 8:
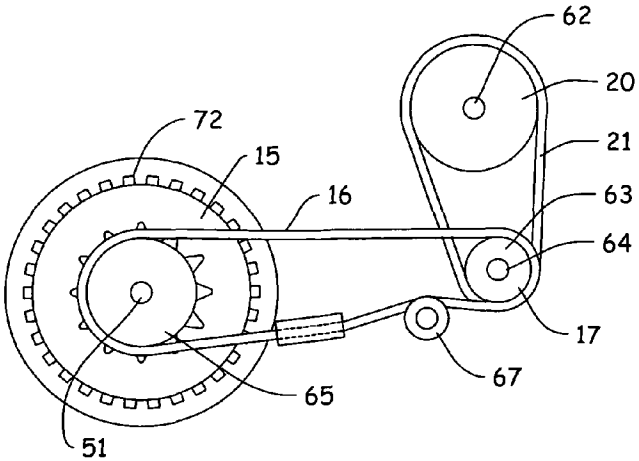
FIG. 8 is full side view of the drive mechanism for the device 1.
Figure 10:
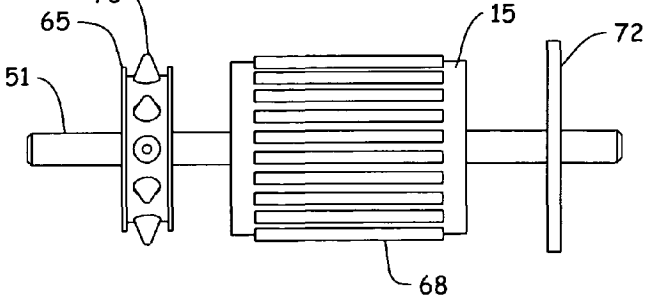
FIG. 10 is a full end view of the axle 51 of this invention showing details of the arrangement of the sprocket and the keeper plate along with the drive wheel.

Turning now to FIG. 8, there is shown a full side view of the components of the drive mechanism for the device 1. Shown in FIG. 8 is the clutch drive 20 that is mounted on the motor shaft 62. Drive chain 21 provides the drive to first drive pulley 63 that is mounted on a common axle 64 with the second drive pulley 17. A drive chain 16 is mounted on the second drive pulley 17 and moves to the sprocket 65 mounted on axle 51. The sprocket 65 is mounted on a common axle 51 with the drive wheel 15 for the drive belt 13. Showing on the back side of the drive wheel 15 is a keeper plate 72 that helps keep the drive belt 13 on the drive wheel 15 and centered thereon.

In addition, there is a chain guide 66 for the chain 16 that prevent the chain from dropping and a chain keeper 67 that prevents the chain from moving laterally and dropping off of the second drive pulley 17.

Figure 11:
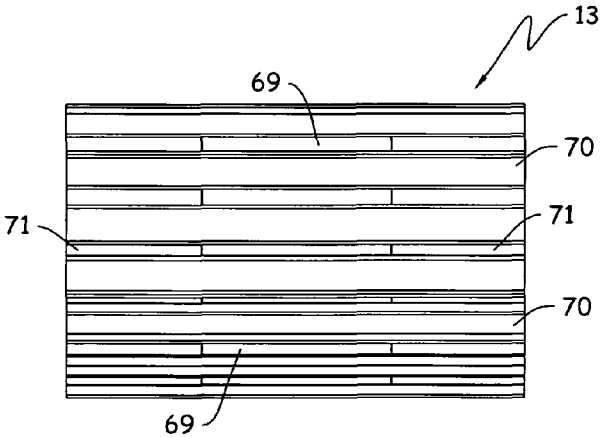
FIG. 11 is a full end view of the drive belt of this invention.

When the engine is running, power is transferred to the clutch wheel assembly 20 and thence by the drive chain 21 to the first drive pulley 63. Because of the common axle 64, the power is transferred to the second drive pulley 17 and thence to the drive chain 16 and thence to the sprocket 65 having teeth 73, which in turns powers the drive wheel 15. The drive wheel 15 has on its center surface, projections 68 that insert in openings 69 (FIG. 11) formed by the placement of drive cleats 70 affixed to the drive belt 13. FIG. 11 is a full end view of a drive belt 13 of this invention in which there is shown the belt 71, cleats 70, and openings 69.

Figure 12:
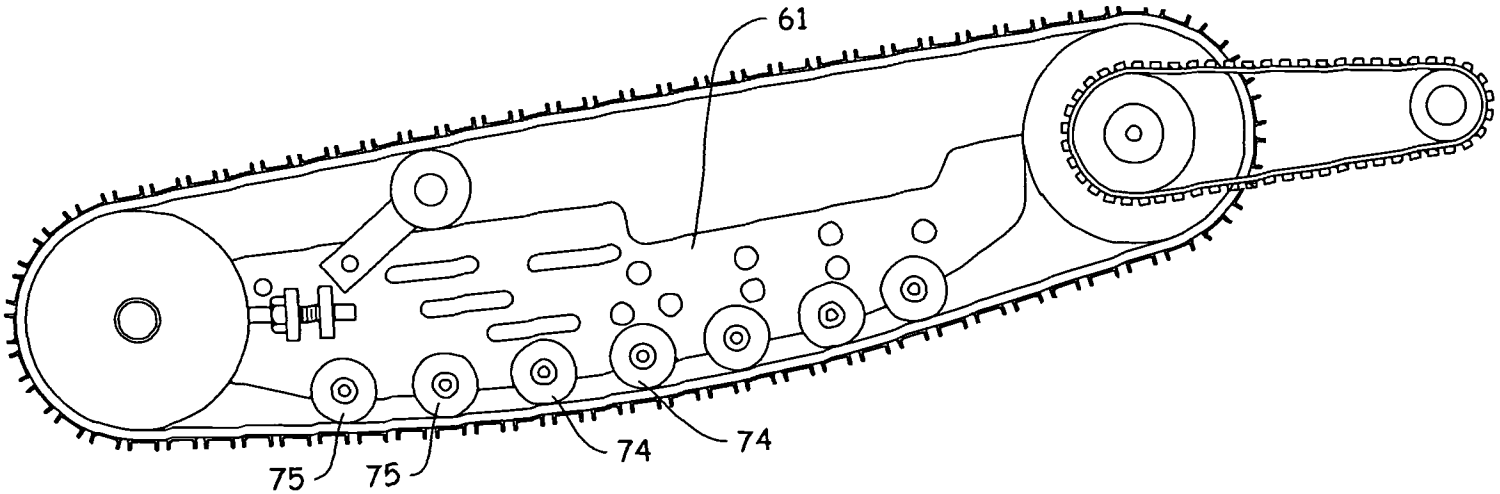
FIG. 12 is a full side view of another embodiment of a drive mechanism of this invention showing the use of wheels inside of the drive belt.

In another embodiment of this invention, and turning to FIG. 12, there is shown a drive assembly for a vehicle of this invention that rides on wheels within the interior of the drive belt 13 so that the vehicle can be used on dry terrain for prolonged periods of time. Thus, there is shown essentially the drive mechanism of FIG. 4 with the addition of wheels 74 that are mounted on axles 75 passing through the bottom of the slider rail 61 then attached to like wheels 74 on the opposite side of the slider rail 61.

The invention claimed is:

1. A powered riding vehicle, said vehicle comprising in combination:

a support frame having a front component with a top, and a distal end portion, and an elevated rear component having a distal portion;

a motor for powering the vehicle, said motor being mounted on the top of said front component and having an exterior drive means;

an endless drive track for said vehicle, said drive track being mounted beneath said elevated rear component and mechanically moveably attached to said exterior drive means of said motor, said drive track being guided by a glide support having a distal end, and guide wheels having a common axle;

a truck mounted beneath said front component and near said distal end portion of said front component thereof, said truck having a distal end, said truck being an assembly that joins a movable ski and said front component of said support frame so that said movable ski is capable of being moved relative to said front component;

said movable ski mounted on the distal end of said truck, said moveable ski having an underside surface;

shock absorbers located and mounted beneath said elevated rear component near said distal portion;

a means of controlling acceleration and deceleration of the motor.

2. The powered riding vehicle as claimed in claim 1 wherein, in addition, there is a drive track tensioning unit mounted on said glide support and in contact with said guide wheels common axle.

3. The powered riding vehicle as claimed in claim 1 wherein, in addition, there is at least one cutting blade mounted on said underside surface of said movable ski.

4. The powered riding vehicle as claimed in claim 3 wherein said blades are mounted near the center of said underside surface of said movable ski.

5. The powered riding vehicle as claimed in claim 1 wherein said moveable ski is essentially flat with parallel edges and said distal end is turned upwardly.

6. The powered riding vehicle as claimed in claim 1 wherein said moveable ski has parallel edges and said parallel edges are turned downwardly, with a distal end turned upwardly.

7. The powered riding vehicle as claimed in claim 6 wherein said blades are mounted near the edge of said underside surface of said movable ski.

8. The powered riding vehicle as claimed in claim 1 wherein said moveable ski has parallel edges and a distal end is rounded in shape and is wider than said parallel edges.

9. The powered riding vehicle as claimed in claim 1 wherein, in addition, said drive track is mounted such that it rotates around a plurality of auxiliary wheels.

10. The powered riding vehicle as claimed in claim 1 wherein the means of controlling the running rate of said motor is an accelerator cable attached to an accelerator of said motor, said accelerator cable having a trigger mechanism.

11. The powered riding vehicle as claimed in claim 1 wherein said motor has attached thereto, a handle for transporting said powered riding vehicle.

* * * * *